US012523391B2

(12) United States Patent
Valdez

(10) Patent No.: US 12,523,391 B2
(45) Date of Patent: Jan. 13, 2026

(54) DUCT REPLACEMENT DEVICE AND METHOD OF USE

(71) Applicant: Raymond Armstrong Valdez, Fountain Valley, CA (US)

(72) Inventor: Raymond Armstrong Valdez, Fountain Valley, CA (US)

( * ) Notice: Subject to any disclaimer, the term of this patent is extended or adjusted under 35 U.S.C. 154(b) by 379 days.

(21) Appl. No.: 18/234,112

(22) Filed: Aug. 15, 2023

(65) Prior Publication Data

US 2023/0383984 A1 Nov. 30, 2023

Related U.S. Application Data

(63) Continuation-in-part of application No. 17/674,040, filed on Feb. 17, 2022, now Pat. No. 11,761,669.

(51) Int. Cl.
*F24F 13/02* (2006.01)

(52) U.S. Cl.
CPC ..... *F24F 13/0245* (2013.01); *F24F 13/0209* (2013.01)

(58) Field of Classification Search
CPC ..... F24F 13/0245; F24F 13/0209
See application file for complete search history.

(56) References Cited

U.S. PATENT DOCUMENTS 6,195,910 B1 * 3/2001 Robineau ..... F26B 21/00 34/607
9,180,584 B1 * 11/2015 Cook ..... B25B 33/00
2004/0237330 A1 * 12/2004 Fuller ..... D06F 58/20 34/140
2010/0223773 A1 * 9/2010 Florian ..... A62C 2/242 29/283
2014/0315481 A1 * 10/2014 Breed ..... F24F 13/082 29/270
2016/0039058 A1 * 2/2016 Cole ..... F24F 13/28 29/428
2023/0003416 A1 * 1/2023 White ..... F24F 13/0245

* cited by examiner

*Primary Examiner* — James M Hewitt, II
(74) *Attorney, Agent, or Firm* — Eric Hanscom

(57) ABSTRACT

A replacement duct sleeve assembly and method of use provides a duct sleeve with a pole adaptor hole on the side that can be attached to a new A/C/heater duct and "fished" into a narrow attic space to a register box, then left in place as the adaptor pole is unscrewed by the pole adaptor, and the pole adaptor is retrieved with a cord. Inside the house, a worker grabs a gripper bar that spans the interior of the duct to work the duct into place. Once in place, plastic zip ties which hold the gripper bar to two mounting braces are snipped, the gripper bar is removed, and the mounting braces are screwed to the sides of the register box, thereby permanently attaching the replacement duct to the register box. A plug is then used to seal the pole adaptor hole.

9 Claims, 11 Drawing Sheets

DUCT REPLACEMENT DEVICE AND METHOD OF USE

CROSS REFERENCE TO RELATED APPLICATIONS

This application is a continuation-in-part application of U.S. Utility patent application Ser. No. 17/674,040 which was filed 17 Feb. 2022, now U.S. Pat. No. 11,761,669, and claimed priority to U.S. Application 63/148,122, filed Feb. 20, 2020.

STATEMENT REGARDING FEDERALLY SPONSORED RESEARCH OR DEVELOPMENT

This invention was not federally sponsored.

INVENTOR

Raymond Armstrong Valdez, resident of USA and citizen of USA.

FIELD OF THE INVENTION

This invention relates to a duct interface device that can be used to easily and effectively connect a new air conditioning or heating duct to an existing register box. A significant advantage provided by this invention is that all the major parts of the invention are either used directly in the invention or can be reused for additional installations.

BACKGROUND OF THE INVENTION

It is well known in the industry that when contractors put register boxes into new houses, they often do not think of how difficult it will be to access and replace the ducts to these boxes, as the initial installation is usually done before ceilings are installed. It is much easier to get on a ladder and place a register box in between ceiling studs than 10 years later, when the heating ducts need to be replaced, to climb into the attic and try to wiggle your body into position to detach the old duct and attach a new one.

Thus, there exists a long-felt need for a device that allows an HVAC worker to easily, safely, and effectively access a register box, remove the old duct and attach a new duct.

The current invention provides just such a solution by having a duct replacement device and method of use provides a duct sleeve flex connector that has a connection to an extension pole by which the duct sleeve is inserted into the desired location. After cutting loose the old duct from under the register box, an HVAC technician enters the attic and threads the device on a telescoping pole, depositing the device near the open register box. To accomplish this, the technician uses a pole with a male-threaded end, and screws this into a female-threaded pole receiver on an adaptor. The adaptor has a female-threaded pole adaptor coupling which has a slightly narrowing diameter which fits into a hole in the side of the replacement sleeve. The angle between the pole receiver and the adaptor couple is adjustable by an angle adjustment thumbscrew, which allows the technician to set the angle of the replacement duct sleeve to ideally position it over a register box. Once the installer has fished the duct assembly with duct end near the register box in the attic, he will then detach the pole from the pole adaptor by turning the pole counter clockwise leaving the duct assembly with the new duct end within arm's length of the air supply register ready for the helper to reach his hand in the attic from the living area and grab the duct assembly by the gripper bar. The key to this part of the invention is that the technician can run a new duct by extension pole to a supply air register from the attic access ladder or a comfortable space in the attic where he can stand up and does not have to crawl through a narrow attic crawl space to run a length of duct across the attic space to the air supply register. Another key advantage is that the helper can make all necessary adjustments and connections needed from a ladder under the register box in the living area, thereby eliminating the need to crawl through an attic space to position and connect the duct with duct tape.

Once the pole is detached from the duct assembly leaving the duct assembly connection near the register in the attic, a helper then climbs a ladder under the register box, reaches into the attic through the existing register and grabs the duct sleeve by a gripper bar and adjusts the device into position. The helper can access the attic from the living space because the old ductwork was removed from the register, creating an opening through the register from the living space into the attic. Once the duct sleeve's male connection is aligned with female connection of the register, the helper pulls downward with force joining the two connections. Once a secure connection is made, the helper snips some plastic zip ties that connect the gripper bar to two mounting braces. Once the zip ties are cut, the helper removes the gripper bar and pulls down on the two mounting braces and screws them into the side of the register box, thereby securing the replacement duct to the register box.

The helper then reaches into the register and unscrews the pole adaptor coupling which causes the pole adaptor to become loose and fall into the attic space for retrieval. The helper then uses a plug to plug up the pole adaptor hole.

As the helper is finishing that part of the job, the technician in the attic retrieves the pole adaptor by pulling on the retrieval tether string that was played out along with the length of duct. The pole adaptor and coupling will be saved and reused.

By using the pole to locate the replacement duct near the register box, the technician is saved from the usual job of crawling over the roof 2×6 beams, getting insulation all over his/her clothes, and taking the chance of missing a beam and putting a hole in the ceiling. Instead, the technician only needs to connect the replacement duct sleeve to a new duct coming off the heater/A/C, then connect the pole to the replacement duct and "fish" the replacement duct to a location right above the register box, where a helper is waiting safely to grab the replacement duct and secure it to the register box safely from the living space.

Prior Art. One prior art is US Publication No. 2016/0039058 to Cole, which describes, as defined in the abstract:

"An air intake of an air handling or hvac system, such as located in a ceiling of a structure, includes a movable filter housing. The filter housing comprises a grate configured to support one or more air filters at a top side thereof. The filter housing is mounted via one or more extendable connectors and includes a control tool mount. Connection of a control tool to the filter housing allows a user to pull the filter housing downwardly to a lowered position for replacing the air filter(s). The filter housing may be biased upwardly to its use position and may include a latch or lock to secure it in the use position."

While this invention is suitable for removing an air filter housing, it is not intended for, nor would it work for "fishing" a replacement duct system in an attic. By definition, both by the written description and illustrations, the Cole invention is suitable for a technician working below a ceiling to replace the air filter. It would not allow a worker in an attic to attach a new duct to a duct replacement assembly and "fish" it toward an existing air register.

There have thus been outlined, rather broadly, the more important features of the invention in order that the detailed description thereof may be better understood, and in order that the present contribution to the art may be better appreciated. There are additional features of the invention that will be described hereinafter, and which will form the subject matter of the claims appended hereto. The features listed herein, and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
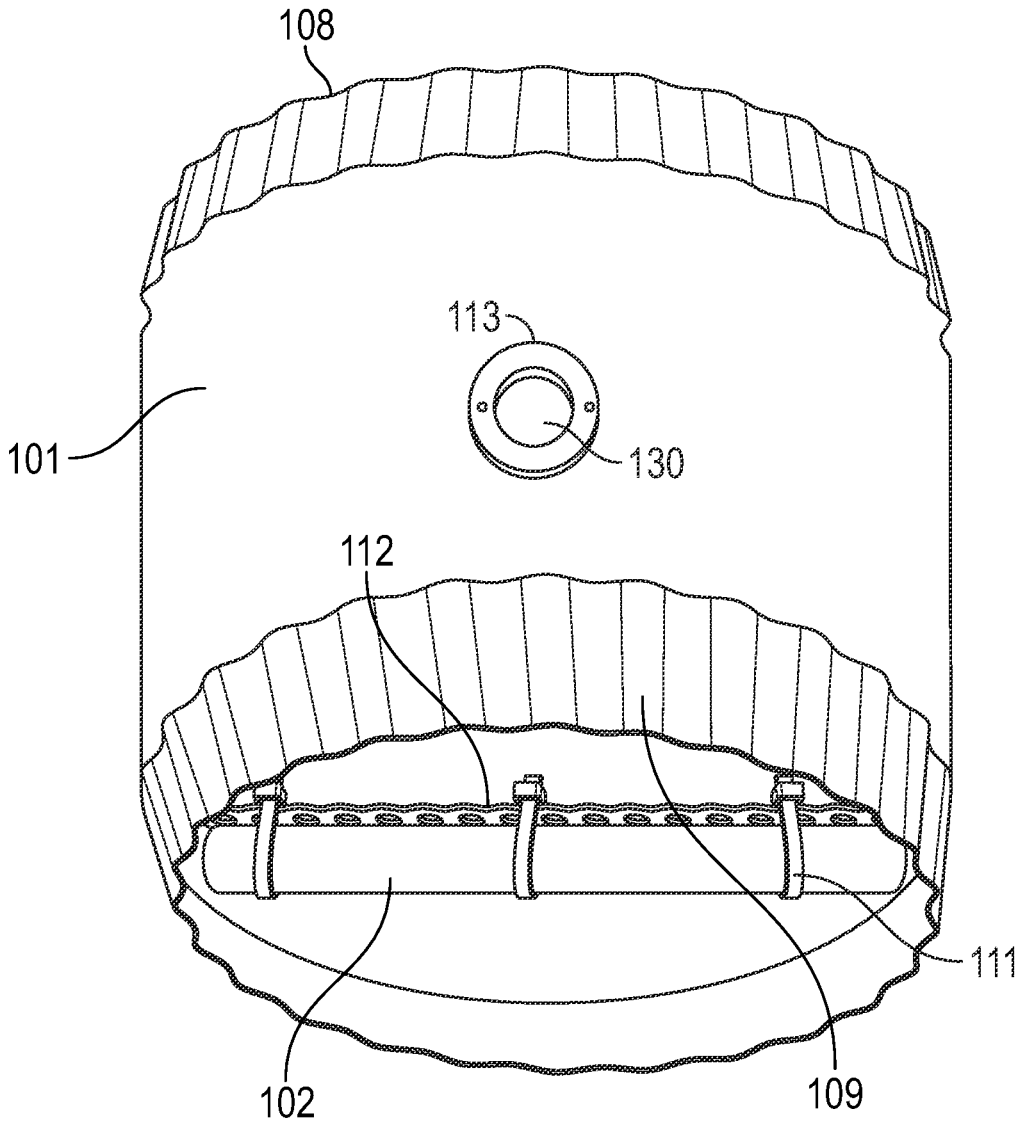
FIG. 1 is a perspective view of the invention with the gripper bar intact.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a perspective view of the invention with the gripper bar intact. The duct sleeve assembly connector, generally 101, has a duct end 108, which attaches to a new A/C or heating duct, and a register end 109, which fits into an existing register. A hole 130 accepts the adaptor and is defined by a metal insert washer 113. At the register end 109 of the duct sleeve assembly connector 101, a gripper bar 102 is attached to two metal bracing strips 112 by plastic zip ties 111. As can be seen in the following illustrations, a technician in the attic attaches the duct sleeve assembly connector 101 to a new flexible duct (118 as seen in other figures) with duct tape to the duct end side 108 of the duct assembly 101, the technician then attaches the pole adaptor (referenced as 10 as seen in other figures) to the duct assembly securing it tightly by screwing the pole adaptor coupling (295 as seen in other figures). The technician then screws an extension pole (107 as seen in other figures) to the adaptor and "fishes" the duct sleeve assembly connector 101 over an existing register (100 as seen in other figures). A second helper under the existing register (168 as seen in other figures), grabs the duct sleeve assembly connector by the gripper bar and maneuvers it into the existing register (100 as seen in other figures). At this point, the gripper bar 102 has served its purpose and is ready for removal and reuse with another job.

Figure 2:
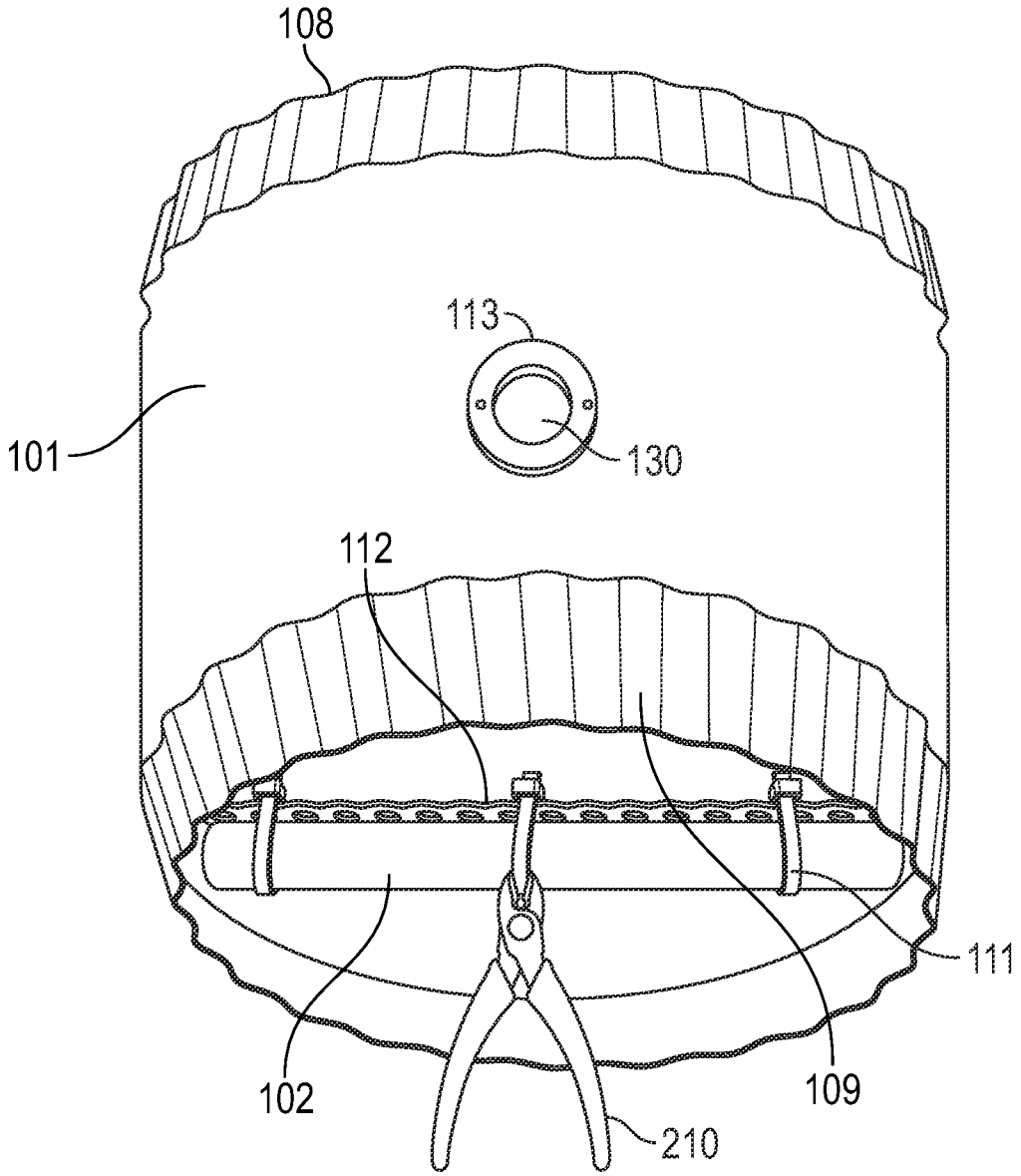
FIG. 2 is a perspective view of the invention while the gripper bar is in the process of being removed.
Figure 10:
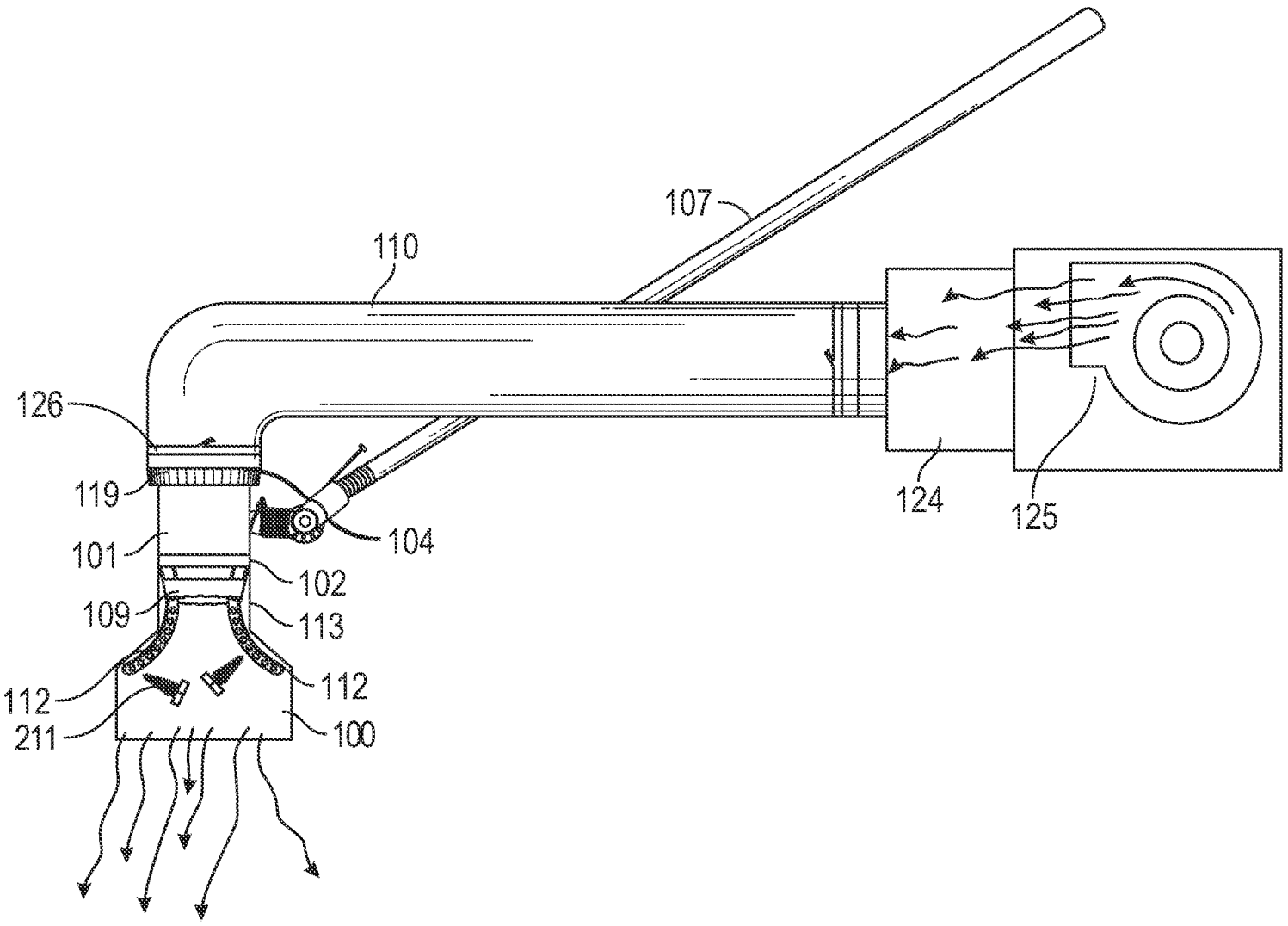
FIG. 10 is a side view of the invention.

FIG. 2 is a perspective view of the invention while the gripper bar is in the process of being removed. A snipping tool 210 is being used to snip the plastic zip ties 111. After all three plastic zip ties 111 are cut, the gripper bar 102 will be removed. This will free up the metal bracing strips 112, by which the duct sleeve assembly connector will be secured to the existing register with screws (211 as seen in FIG. 10).

Figure 3:
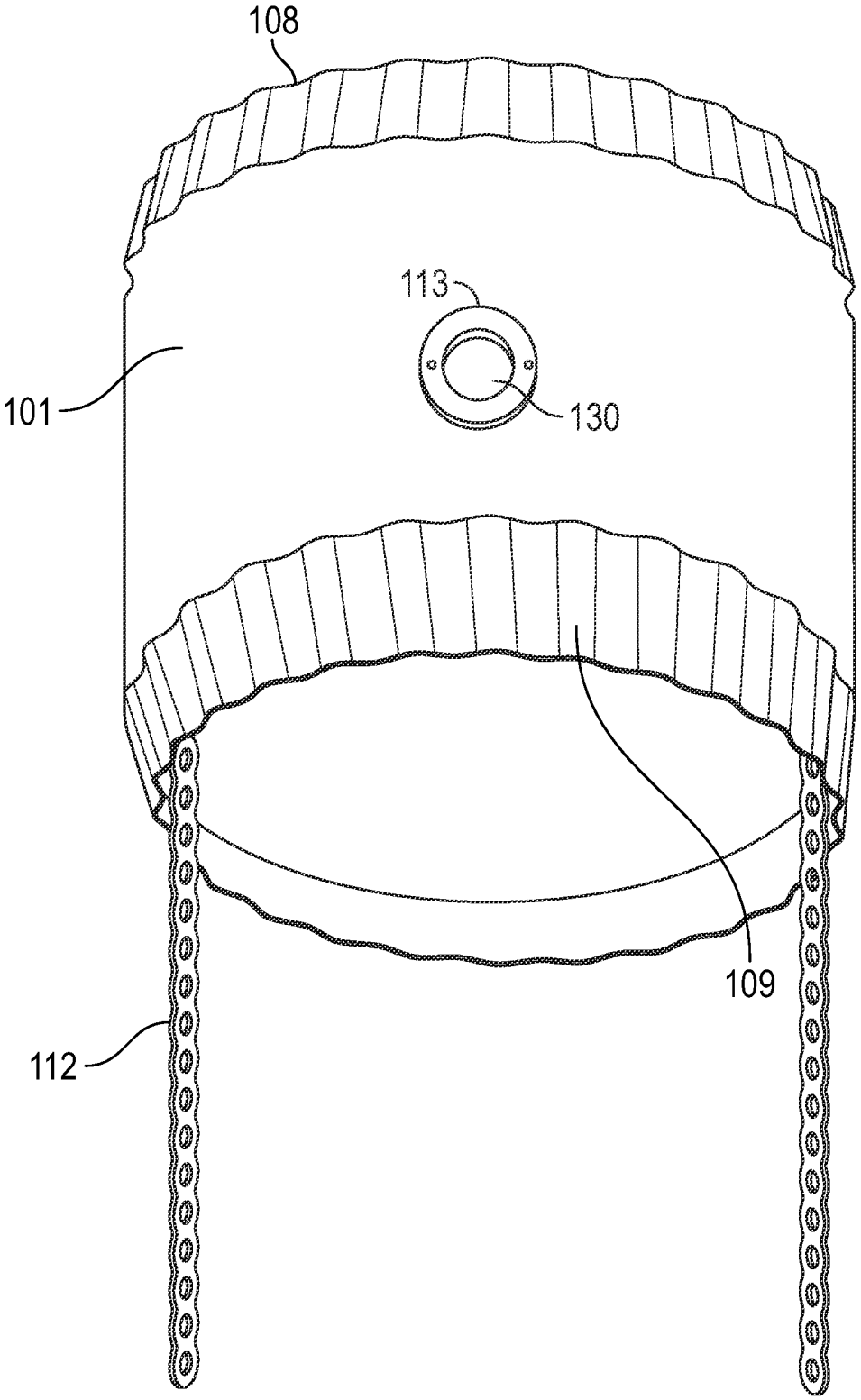
FIG. 3 is a perspective view of the invention after the gripper bar has been removed.

FIG. 3 is a perspective view of the invention after the gripper bar has been removed. The technician pulls down on the now-free metal bracing strips 112 and, with screws (211 as seen in FIG. 10), attaches them to the side walls of the existing register to secure the duct sleeve assembly connector to the existing register giving the bond seismic stability.

Figure 4:
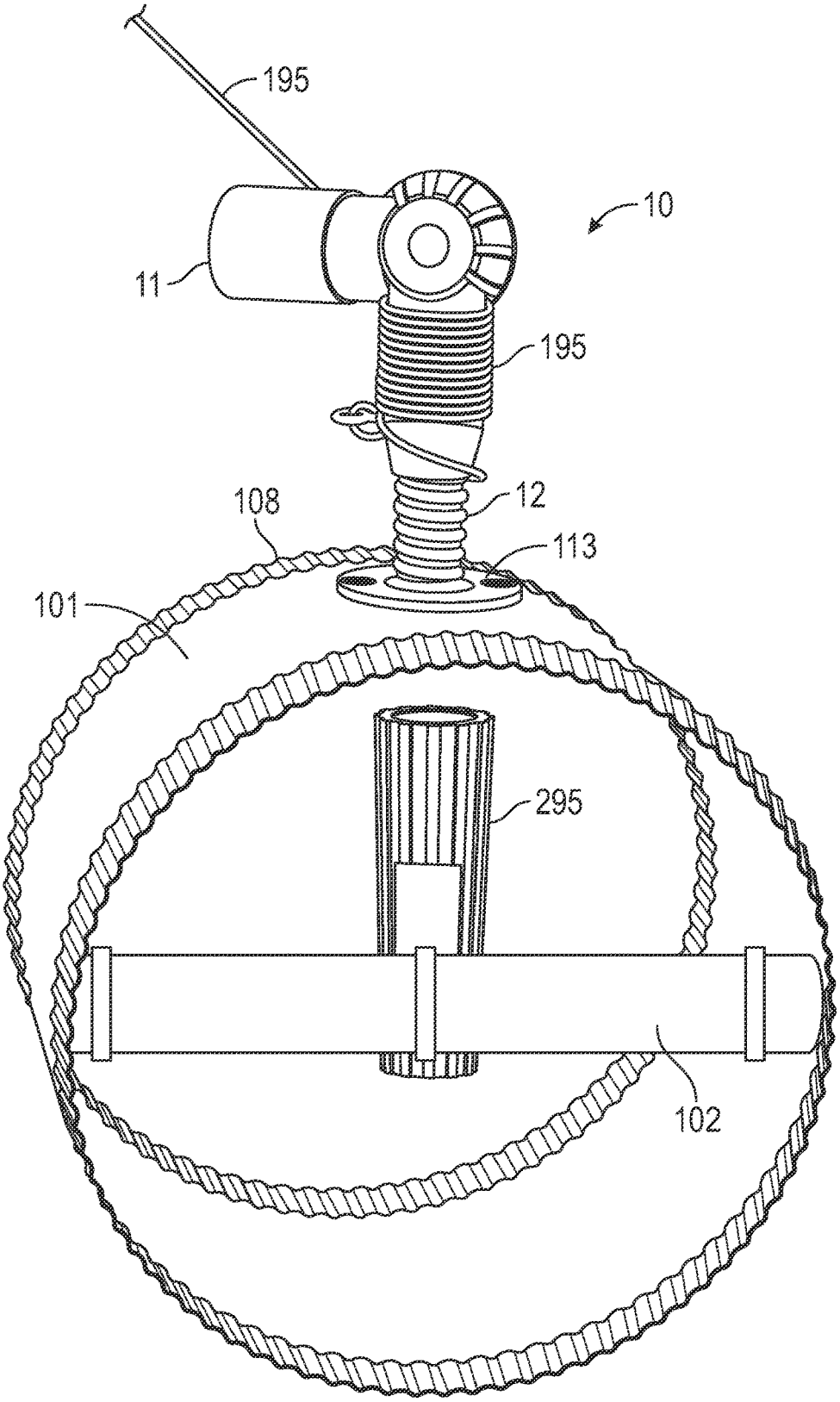
FIG. 4 is a bottom view of the invention, showing how the adaptor is attached.

FIG. 4 is a bottom view of the invention, showing how the adaptor, generally 10, is attached to the duct sleeve assembly connector, generally 101. The adaptor, generally 10, has a female-threaded pole receiver 11, into which male threads of the pole are inserted. A tether 195 is wound around the adaptor, then secured to the belt or other part of the technician in the attic, and played out as the female-threaded pole receiver is "fished" over to the existing register. This entire process is complete in the attic, as opposed to the Cole reference where the work is done from a living space under an existing register. The pole adaptor 10 is temporarily attached to the duct sleeve assembly connector 101, the adaptor's threaded end 12 is inserted through the hole that is defined by the metal insert washer 113, and a female-threaded adaptor coupling 295 is screwed onto the threads of the adaptor, securing a snug connection between the pole adaptor 10 and the assembly body 101. The angle between the pole and the duct sleeve assembly connector can be adjusted by an angle adjustment screw 104. In this figure, the gripper bar 102 is still in place, waiting for a technician to grab it and secure the duct sleeve assembly connector into an existing register.

Figure 5:
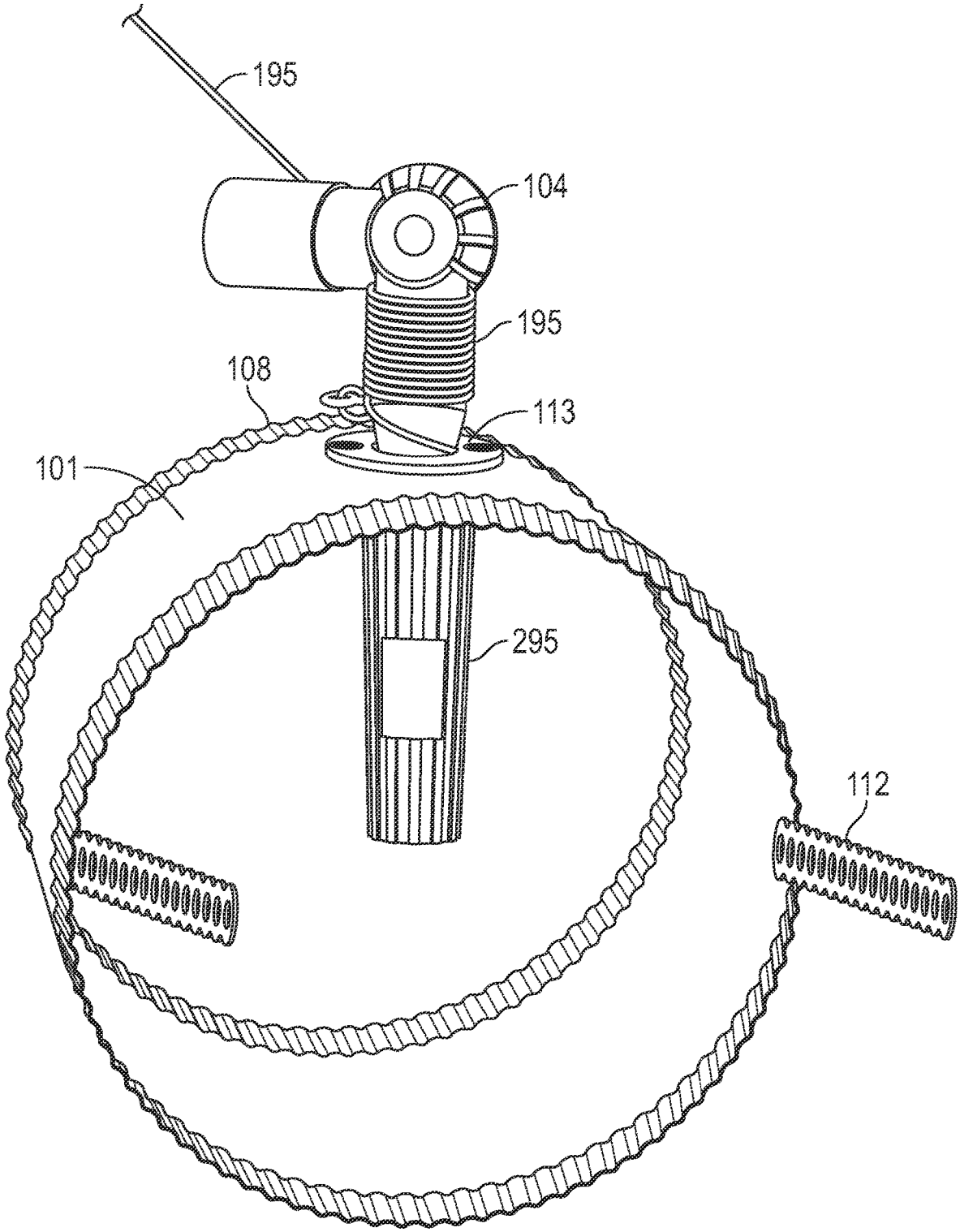
FIG. 5 is a bottom view showing how the metal bracing strips extend from the invention after the gripper bar has been removed.

FIG. 5 is a bottom view showing how the metal bracing strips 112 extend from the invention after the gripper bar has been removed. In this figure, the technician under the existing register has removed the gripper bar and has pulled down the metal bracing strips 112, in preparation for screwing them into the side of the existing register 211 (see FIG. 10), thereby securing the duct sleeve assembly connector into an existing register (see FIG. 10). Once this is accomplished, the helper will unscrew the female-threaded adaptor coupling 295, put it in a safe place for reuse on another job, and push the adaptor back through the hole causing it to fall into the attic space. At that point the technician in the attic will pull on the tether 195 to retrieve the adaptor. The technician under the existing register will then insert a plug into the metal insert washer 113 to prevent air leakage when the a/c is operational.

Figure 6:
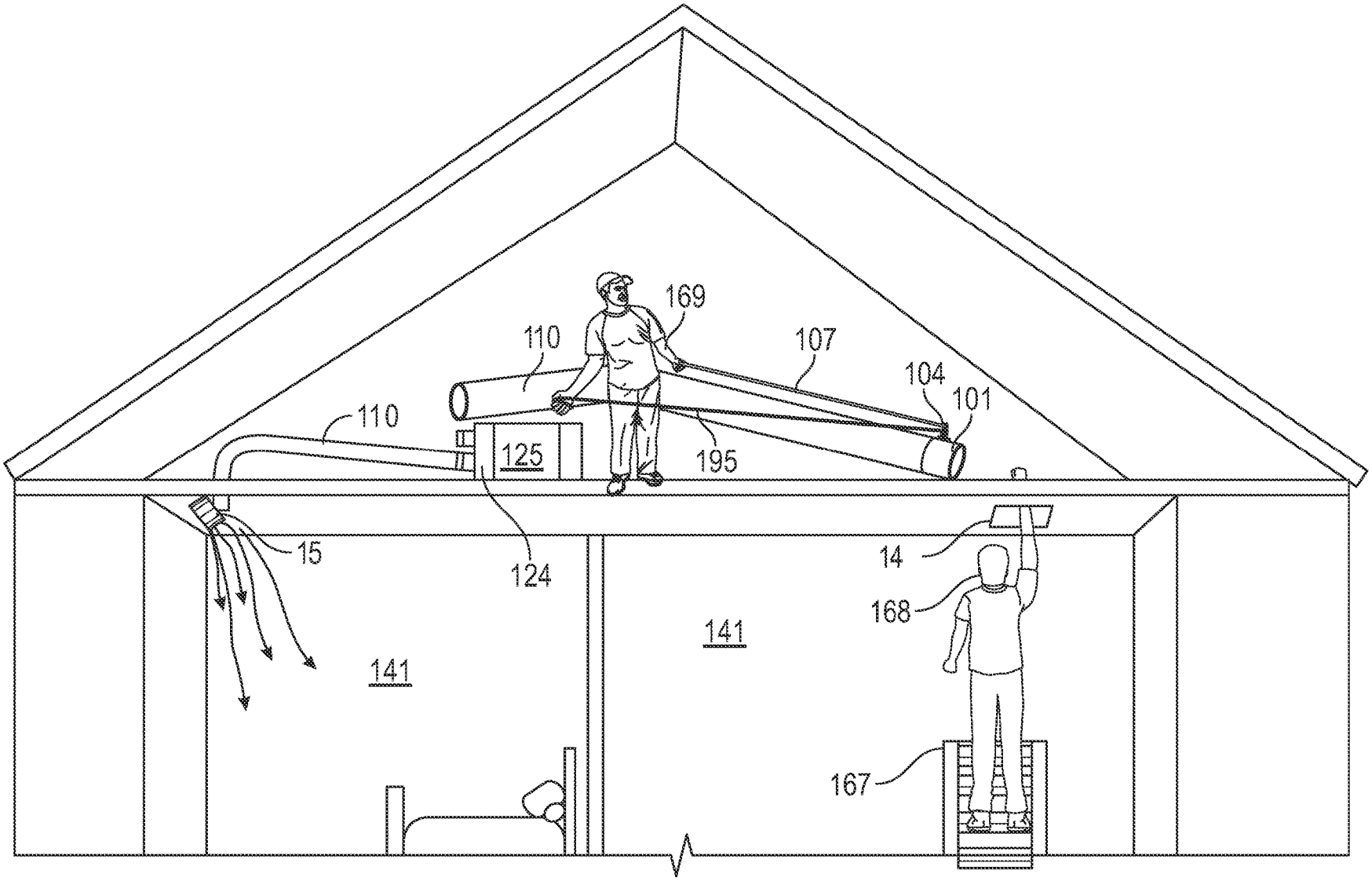
FIG. 6 is a cut-away side view of a house showing the difference in "ease of replacement" between a traditional HVAC worker and one using the invention.

FIG. 6 is a cut-away side view of a house showing the ease of replacement for a HVAC worker using the invention. A first technician 168, in a room 141, has climbed a ladder 167 and stuck a hand through an existing register 14. A second technician 169, is in the attic, "fishing" a duct sleeve assembly connector 101 at the end of a new duct 110 toward the existing register 14. The angle adjustment screw 104 adjusts the angle between the pole 131 and the duct sleeve assembly connector 101. This allows the duct sleeve assembly connector 101 to be aimed directly over the existing register 14 so that the first technician 168 can grab it by its gripper bar. Once the first technician secures the new duct to the existing register, the second technician grabs the other end of the new duct and secures it to the A/C/heater connector 124 of the A/C/heater unit 125. This method allows technicians to attach new ducts 110 to existing registers in narrow and tight corners, and supply fresh air 15 to rooms without having to crawl over the bottom of the attic. This prevents the danger of a technician falling between the attic studs and also keeps technicians from breathing in the dirt and dust that are common in attics.

Figure 7:
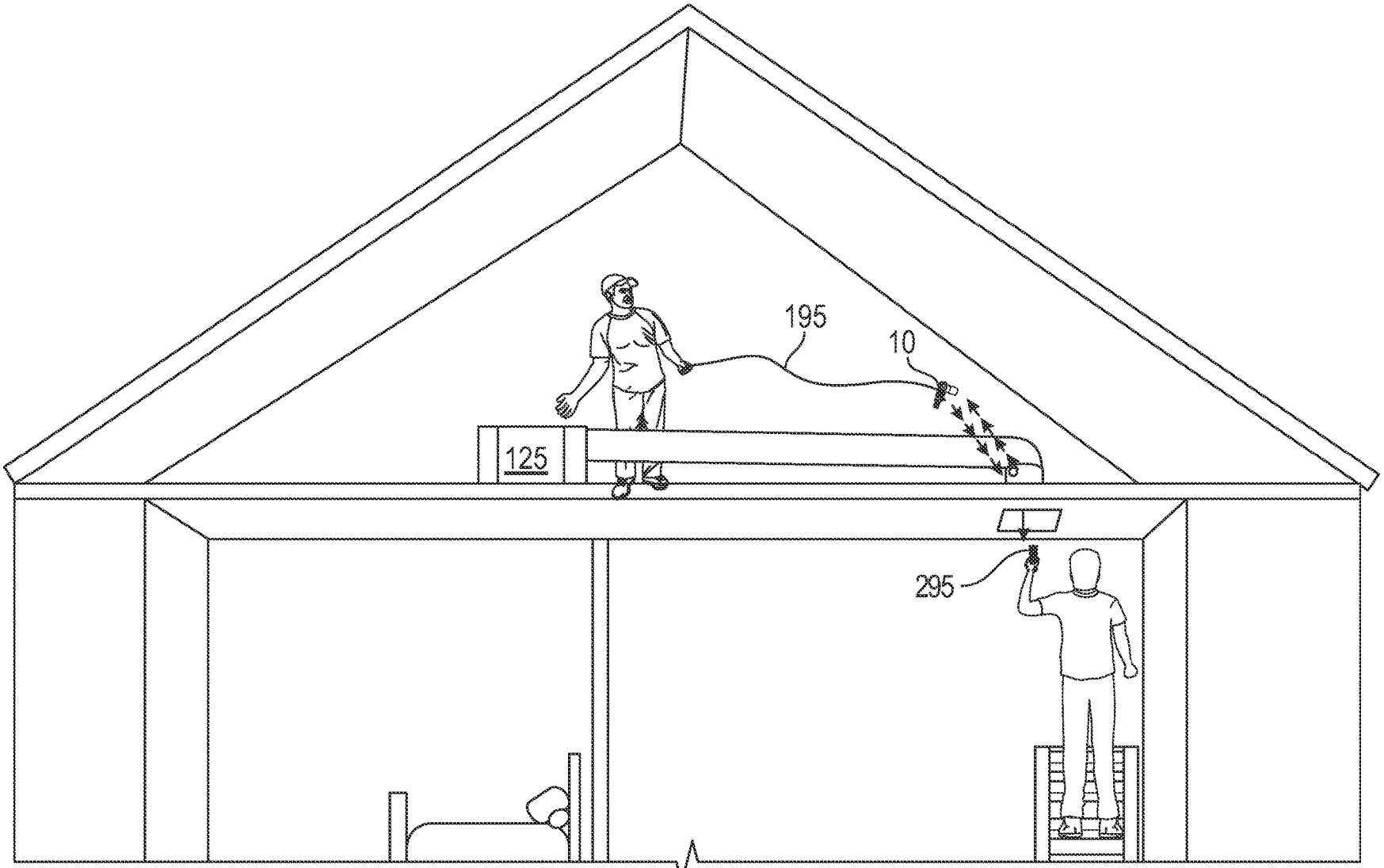
FIG. 7 is a cut-away side view of a house showing the technician in the attic retrieving the adaptor after successfully "fishing" the duct to the technician working under the existing register.

FIG. 7 is a cut-away side view of a house showing the technician in the attic retrieving the adaptor 10 after successfully "fishing" the duct to the technician working under the existing register. The technician in the attic merely pulls on the tether 195 to retrieve the adaptor 10, which the technician in the room retains the female-threaded adaptor coupling 295.

Figure 8:
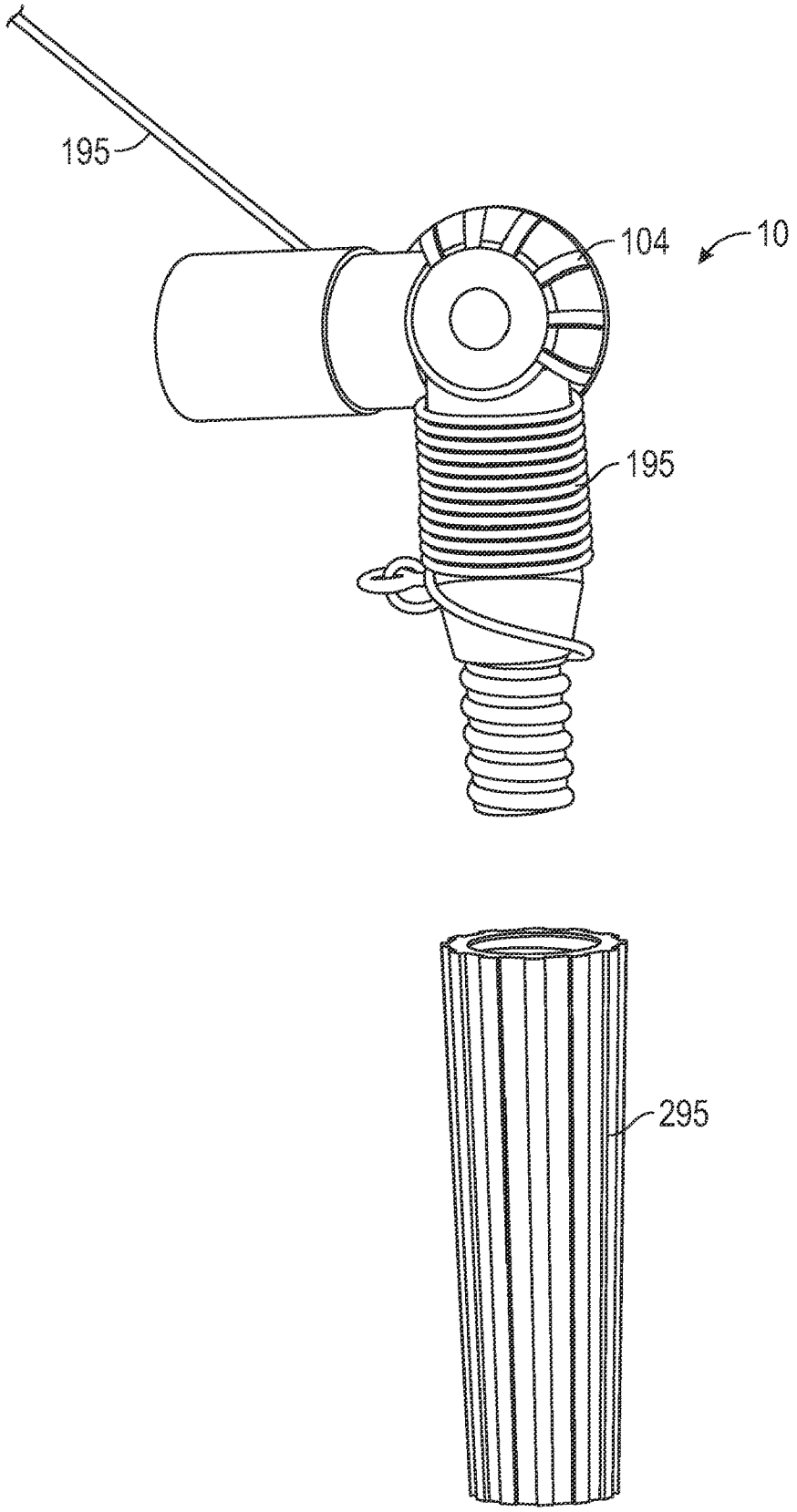
FIG. 8 is a side view of the adaptor portion of the invention.

FIG. 8 is a side view of the adaptor portion, generally 10, of the invention. The adaptor, generally 10, has a female-threaded pole receiver 11, into which male threads of the pole are inserted. A tether 195 is wound around the adaptor, then secured to the belt or other part of the technician in the attic, and played out as the female-threaded pole receiver is "fished" over to the existing register. The adaptor is temporarily to the duct sleeve assembly connector, the adaptors threaded end 12 is inserted through the hole that is defined by the metal insert washer 113, and a female-threaded adaptor coupling 295 is screwed onto the threads of the adaptor. The angle between the pole and the duct sleeve assembly connector can be adjusted by an angle adjustment screw 104. In this figure, the gripper bar 102 is still in place, waiting for a technician to grab it and secure the duct sleeve assembly connector into an existing register.

Figure 9:
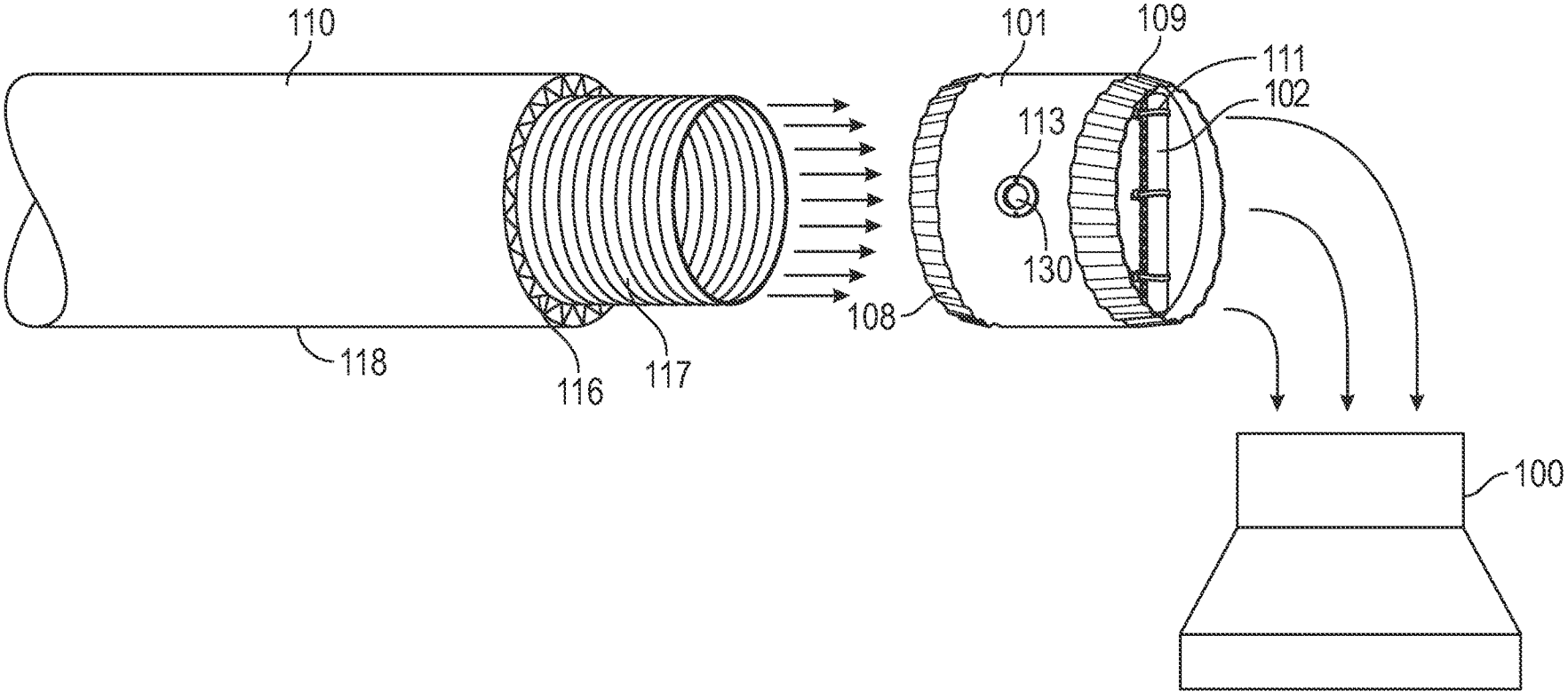
FIG. 9 is a side, exploded view of the invention.

FIG. 9 is a side, exploded view of the invention. The invention 101 is being lined up over an existing register 100. A new flexible duct 110 will be inserted into the invention 101 by first taping a plastic wired tube 117 to the duct end 109 of the assembly then pulling the insulation 116 and vapor barrier 118 over the wired tube connection and taping again for added protection 101. The new duct 110 is covered by a vapor barrier 118, which covers an insulating layer of glass wool 116 over a tube 117. The tube 117 is inserted into invention 101. A technician grabs the gripper bar 102 to direct the invention into the existing register 100 the technician will align the male end 109 with the female connection of the register 100 and connect the two by pulling down on the gripper bar with force making a tight connection. The plastic zip ties 111 will then be cut and the gripper bar will be removed.

FIG. 10 is a side view of the invention showing how it is used to position a duct sleeve assembly connector 101 over and into an existing air register 100. From an AC/Heater 125, an AC/Heater connector 124 mates with a new duct 110, which mates with the duct sleeve assembly connector 101. Before this invention, a technician would have to crawl on his/her belly across dirty, messy ceiling insulation, being careful not to punch a knee through the ceiling or hit his/her head on the roof. Now, with this invention, the technician can perform the entire job at the AC/Heater, in a standing position, in an attic. The technician enters the attic and connects the new duct to the AC/Heater, then connects the duct sleeve assembly connector 101 to the other end of the new duct 110 with duct tape. The technician then connects the pole adaptor 10 to the duct assembly 101. The technician then takes a lengthy extension pole 107 and screws its male threads to the female threads of the pole adapter 10. the technician Then and uses the pole 107 to "fish" a length of duct and the assembly 101 across the attic over the existing register 100. The pole 107 is then disconnected by unscrewing the pole counterclockwise leaving the duct assembly 101 within an arm's length of the register. The helper that is under the register (168 in other figures) grabs the assembly by the gripper bar (102 in other figures) and joins the male connection 109 of duct assembly 101 with the female connection of the existing register 100 by pulling force. Plastic ties are then cut (111 in other figures) and the gripper bar is removed (102 in other figures). With the gripper bar now removed the helper will lower the two mounting straps 112 and screw them 211 to the side walls of the register bracing the entire duct assembly 101 to the register 100, giving it seismic stability. The helper will then reach in the assembly 101 and loosen the adapter coupling (295 in other figures) causing the adapter 10 to fall into the attic and be retrieved by the technician in the attic. The helper will then plug the pole adaptor insert hole with a rubber plug. The helper will seal all joint seams between the register 100 and the duct assembly 101 with tape and mastic duct sealer. The new duct installation is now complete, and completed without anyone having to crawl over the roof rafters to reach a narrow corner or otherwise hard-to-reach section of the attic.

Figure 11:
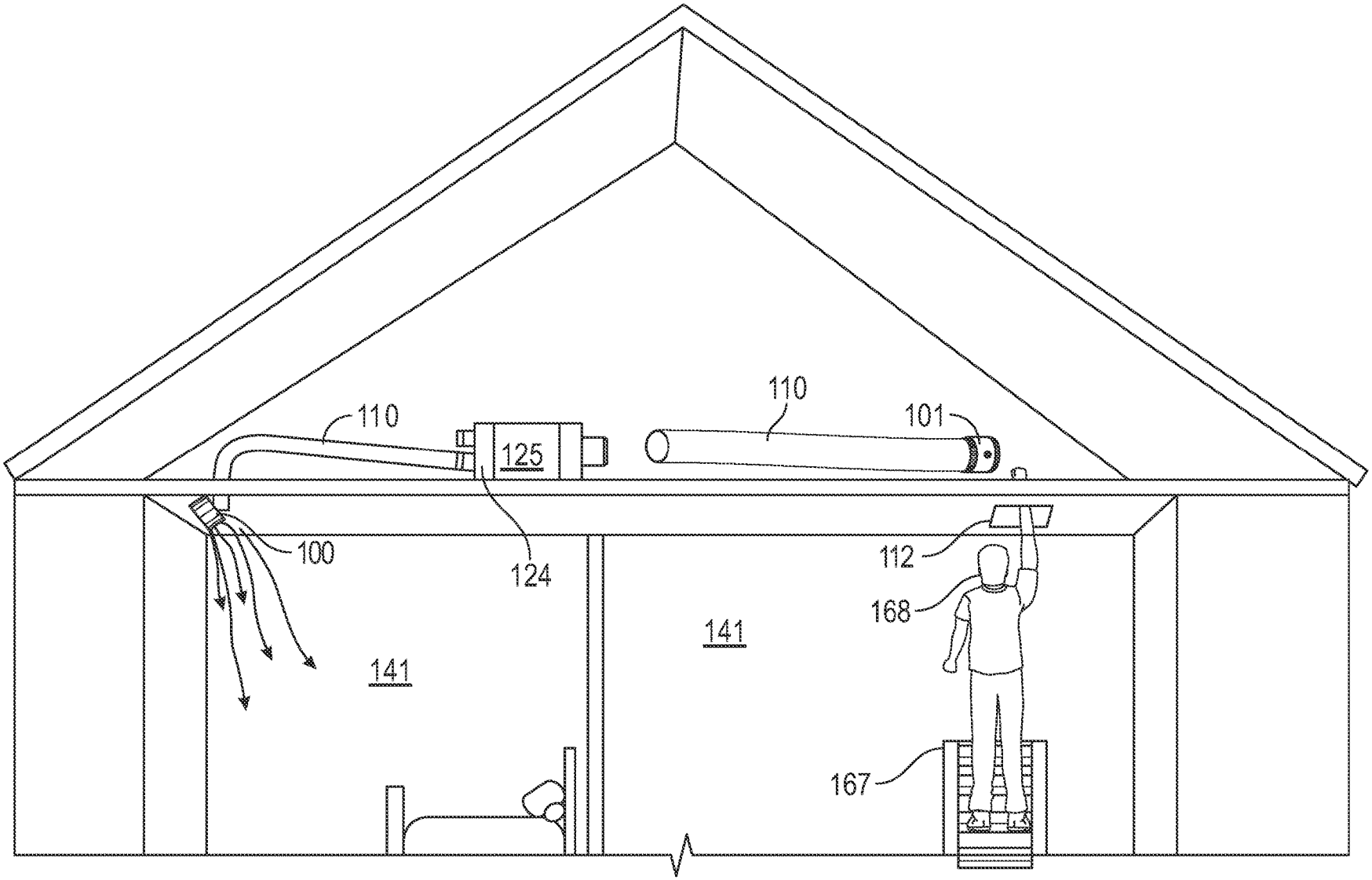
FIG. 11 is a side, cut-away view of a single technician installing a new duct by himself.

FIG. 11 is a side, cut-away view of a single technician installing a new duct by himself. In this figure, the technician 168 has already crawled up in the attic and has "fished" the new duct with the invention 101 close to an existing register hole. He is reaching up, ready to grab the invention by the gripper bar, after which he will center the invention into the existing air register and secure it with screws. After attaching the invention to the existing register, the technician will climb back into the attic and attach the open end of the new duct to the AC/Heater 125 to complete the installation.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent or its disclosure, as it appears in official governmental records but, otherwise, all other copyright rights whatsoever are reserved.

That which is claimed:

1. A device for connecting a new duct to an existing register box, comprising: a duct sleeve assembly connector and a pole device, wherein the replacement duct comprises a body with a flexible duct end and a register box end, with an outer surface and an inner surface, a gripper bar, two metal bracing strips, wherein the body has a pole adaptor hole in the side of the body, wherein the pole adaptor hole is defined by a hole in the body surrounded by a metal insert washer, wherein the gripper bar is attached to the two metal bracing strips by two or more plastic zip ties, wherein the pole device comprises a pole with a male connector end and an adaptor, where the adaptor comprises a female threaded pole receiver, which mates with the male connector end, an angle adjustment screw, a female-threaded adaptor coupling, and a retrieval tether, where the female-threaded pole adaptor coupling has an insert end that fits inside the hole in the body, wherein the angle adjustment screw adjusts the angle between the female threaded pole receiver and the female threaded pole adaptor coupling, such that the replacement duct can be angled during a replacement job by adjusting the angle adjustment screw, such that the replacement duct is attachable to a new A/C/Heading duct and located above an existing register box in a house ceiling, and the gripper bar can be secure the replacement duct in the existing register box, and the gripper bar can be removed from the replacement duct when the two or more plastic zip ties are cut, and wherein the two metal bracing strips are pulled down and attached to one or more sides of the existing register box with one or more screws, wherein, the male connector end is unscrewed from the female threaded pole receiver, wherein the adaptor is jiggled free of the hole, wherein the retrieval tether is used to retrieve the adaptor, wherein, a plug is attached to the hole in the body of the replacement duct which covers up the hole.

2. The device of claim 1, wherein the duct sleeve assembly is a metal duct sleeve assembly.

3. A device for connecting a new duct to an existing register box, comprising: a duct sleeve assembly connector and a pole device, wherein the duct sleeve assembly connector comprises a connector body with a flexible duct end and a register box end, with an outer surface and an inner surface, a gripper bar, two metal bracing strips, wherein each of the two metal bracing strips are attached on an inside surface of the connector body at a connection end, and where each of the two metal bracing strips has an open end, were each of the open ends are folded together to form a temporary bridge that extends from a first side of the connector body to a second side of the connector body, wherein the gripper bar is removably attached to the temporary bridge by one or more zip ties, wherein the pole device removably attaches to the duct sleeve assembly connector, wherein the pole device locates the duct sleeve assembly connector over the existing register, wherein the duct sleeve assembly connector connects to the existing register, thereby connecting the new duct to the existing register.

4. The device of claim 3, wherein the gripper bar is attached to the two metal bracing strips by two or more plastic zip ties, wherein the gripper bar allows the duct sleeve assembly connector to be inserted into the existing register.

5. The device of claim 4, wherein the body has a pole adaptor hole in the side of the body, where the pole adaptor hole is defined by a hole in the body surrounded by a metal insert washer.

6. The device of claim 5, wherein the pole device comprises a pole with a male connector end and an adaptor, where the adaptor comprises a female threaded pole receiver, which mates with the male connector end, an angle adjustment screw, a female-threaded pole adaptor coupling, and a retrieval tether, wherein the female-threaded pole adaptor coupling has an insert end that fits inside the hole in the body, wherein the angle adjustment screw adjusts the angle between the female threaded pole receiver and the female threaded pole adaptor coupling, such that the replacement duct can be angled during a replacement job by adjusting the angle adjustment screw, such that the replacement duct is attachable to a new A/C/Heading duct and located above an existing register box in a house ceiling, and the gripper bar is used to secure the replacement duct in the existing register box.

7. The device of claim 6, wherein the gripper bar is removable from the replacement duct when the two or more plastic zip ties are cut, and wherein the two metal bracing strips are pulled down and attached to one or more sides of the existing register box with one or more screws.

8. The device of claim 7, wherein, the male connector end is unscrewed from the female threaded pole receiver, wherein the adaptor is jiggled free of the hole, wherein the retrieval tether is used to retrieve the adaptor.

9. The device of claim 8, wherein, a plug is attached to the hole in the body of the replacement duct which covers up the hole.

* * * * *